US005358248A

United States Patent [19]

Jankosky

[11] Patent Number: 5,358,248

[45] Date of Patent: Oct. 25, 1994

[54] GOLF BOARD GAME

[76] Inventor: Joseph R. Jankosky, 421 Toledo Dr., Lower Burrell, Pa. 15068

[21] Appl. No.: 184,170

[22] Filed: Jan. 21, 1994

[51] Int. Cl.[5] ..... A63F 3/00

[52] U.S. Cl. ..... 273/153 J; 273/245; 273/282.1

[58] Field of Search ..... 273/245, 264, 266, 271, 273/282.1, 153 J; 446/118

[56] References Cited

U.S. PATENT DOCUMENTS

| | | | |
|---|---|---|---|
| 237,053 | 1/1881 | Schumaker | 273/153 J |
| 357,923 | 2/1887 | Hanson | 273/153 J |
| 484,882 | 10/1892 | Rickert . | |
| 623,876 | 4/1899 | Breitenbach . | |
| 1,133,546 | 3/1915 | Fitzgerald | 273/153 J |
| 1,136,625 | 4/1915 | Sonsikowski et al. | 446/118 X |
| 1,497,087 | 6/1924 | Butler et al. . | |
| 1,725,911 | 8/1929 | Graham | 446/118 |
| 2,569,637 | 10/1951 | Loe . | |
| 2,712,938 | 7/1955 | Brown | 273/153 J |
| 2,757,004 | 7/1956 | Schmitt . | |
| 2,778,640 | 1/1957 | Brown | 273/153 J |
| 2,778,641 | 1/1957 | Brown | 273/153 J |
| 3,074,721 | 1/1963 | DeMoon | 273/153 J |
| 4,113,260 | 9/1978 | Sain . | |
| 4,277,065 | 7/1981 | White . | |
| 4,598,912 | 7/1986 | Kendrick et al. . | |
| 4,635,939 | 1/1987 | Makow . | |
| 5,188,369 | 2/1993 | Loewenton | 273/153 J X |
| 5,246,230 | 9/1993 | McLellan | 273/153 J |

FOREIGN PATENT DOCUMENTS

| | | | |
|---|---|---|---|
| 3607538 | 9/1987 | Fed. Rep. of Germany | 273/153 J |

*Primary Examiner*—William E. Stoll

[57] ABSTRACT

A golf board game has the graphic likeness of one or more golf holes, each comprising distinct tee, fairway, green, cup, rough and optionally, out-of-bounds, and sand and water hazard areas, depicted on a playing surface overlaid with an array of orthogonally and diagonally aligned position marks. Playing pieces are initially placed on most but not all of the position marks and play commences by the iterative jumping of one piece over an adjacently located second piece and onto an in-line, adjacent position mark and the removal of the jumped piece from the board. Play continues until no more such jumps can be made. Each remaining playing piece is assessed strokes based on the area of the golf hole on which the pieces remain and the stroke values associated with such areas. A player's score for a hole is the total number of such strokes.

3 Claims, 3 Drawing Sheets

GOLF BOARD GAME

BACKGROUND OF THE INVENTION

Field of the Invention

The present invention pertains to board games generally and, more particularly, to a game of skill played on a board adorned with the likeness of a golf hole.

Discussion of the Prior Art

A number of games have golf as a theme, the likeness of one or more golf holes printed on a playing board and various rules of play. In one approach, exemplified by U.S. Pat. No. 4,277,065 (White), playing pieces are moved from a teeing area to a green and into a cup in response to instructions carried on the various faces of die selected and rolled by the players. In another format exemplified by U.S. Pat. No. 4,113,260 (Sain) playing markers are directed by a combination of dice and spinner instructions across a fairway and into a golf cup. In both of these types of golf games the number of turns required to successfully move the marker from tee to cup is treated as the number of strokes required to play the hole. U.S. Pat. No. 4,598,912 (Kindrick et al) shows a variation on the card game of cribbage adapted to be played on a board decorated with golf course indicia and having detours representing hazards that lengthen the path of the player.

Another class of games, exemplified by U.S. Pat. No. 2,757,004 (Schmitt), is played on a board having a matrix arrangement of pegholes and correspondingly sized pegs. Pegs are inserted into the pegholes such that at least one peghole is left open. Play commences by jumping one peg over another to land at an open peghole and removing the jumped peg from the board as is done in checkers. The game concludes when no more jumps can be made and the objective is generally to remove as many pegs as possible and in some instances to have a remaining last peg end up in a particular peghole.

None of these games provide the players with strategic choice-making challenges while simultaneously providing a golfing theme in a simple yet flexible format.

SUMMARY OF THE INVENTION

Accordingly, it is a primary object of the present invention to overcome the above-mentioned disadvantages of the prior art by providing a game of skill and strategy having a golf game theme.

Another object of the present invention is to provide a golf game or puzzle that can be played alone or as a competition between players or teams.

Yet another object of the present invention is to provide a simple table-top golf game requiring very little specialized equipment and limited set-up time to provide a peg-jumping game having an appearance and a scoring system related to the game of golf.

A further object of the present invention is to provide a golf-theme table-top game or puzzle that is diverting and entertaining yet amenable to simultaneous socializing and conversation typical of post-golf relaxation diversions.

Still another object of the present invention is to provide a unique golf oriented scoring procedure for a peg-jumping board game.

Some of the advantages of the present invention over the prior art are that the golf game or puzzle of the present invention is entertaining and challenging yet easy to learn, set-up and play, can be used to amuse a single player or a group, and is simple and inexpensive to manufacture.

The present invention is generally characterized as a playing board having the graphic likeness of a golf hole imprinted on the upper surface and an array of pegholes or other position marks covering the area between and including a tee area and a green located on opposite ends of the playing surface. Playing pieces in the form of pegs or marbles or other markers are placed on each of the position marks except that at least one position must remain open. Play of the game or puzzle comprises jumping one playing piece with another checker-style, until no more jumps can be made, whereupon the number and location of remaining playing pieces is correlated to the players score on a golf hole.

Other objects and advantages of the present invention will become apparent from the following description of the preferred embodiment taken in conjunction with the accompanying drawings.

DESCRIPTION OF THE PREFERRED EMBODIMENT

Figure 1:
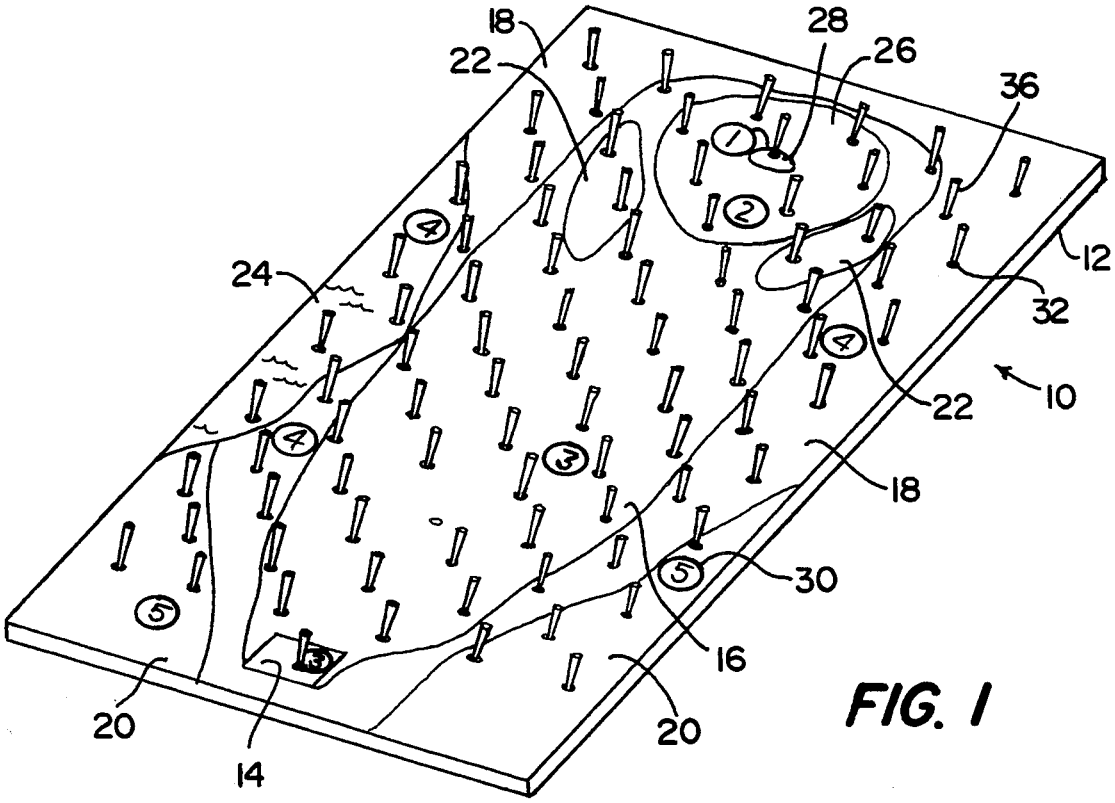
FIG. 1 is a perspective view of the playing board of the golf game or puzzle of the present invention with peg-like playing pieces occupying most of the position marks.
Figure 2:
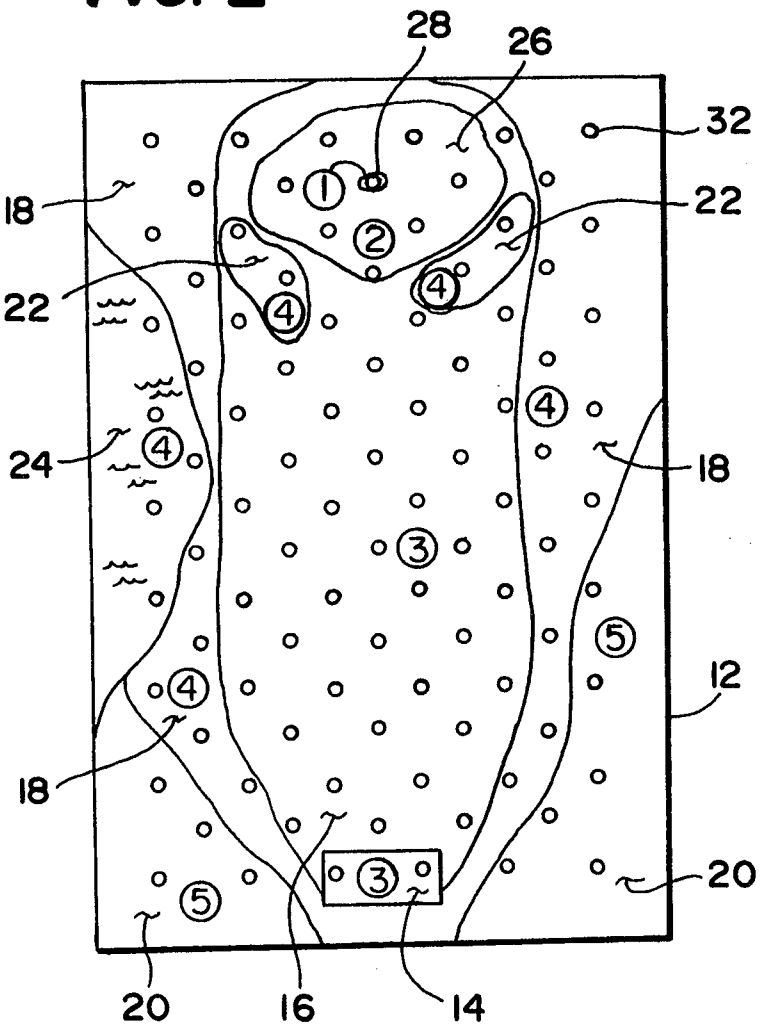
FIG. 2 is a plan view of the playing board of the present invention.

The golf game 10 of the present invention is shown in FIG. 1 having graphic indicia of a golf hole affixed to a game board 12. The golf hole is represented by distinctly differentiated areas comprising a tee 14, a fairway 16, rough 18, out-of-bounds 20, sand traps 22 and water hazards 24, a green 26 and a cup 28. Due to differing designs of golf holes, all golf holes contain a tee, a fairway, a green and a cup, however, rough, out-of-bounds, sand traps and water hazards are optional with each golf hole normally containing one or more of these features. The depicted golf hole can be generic in nature, representative of an average, or typical, golf hole, or can be specifically shaped and configured to characterize a specific well-known or classic golf hole. Each area is marked with a stroke value 30 used in scoring the game as will be explained later. An array of position marks 32 is superimposed over the golf hole game board 12 as shown in FIG. 2. This array is comprised of rows and columns of marks 32 evenly spaced between rows and columns with alternating rows staggered or displaced, by half the distance between rows and columns to align marks both orthogonally and diagonally.

Figure 3:
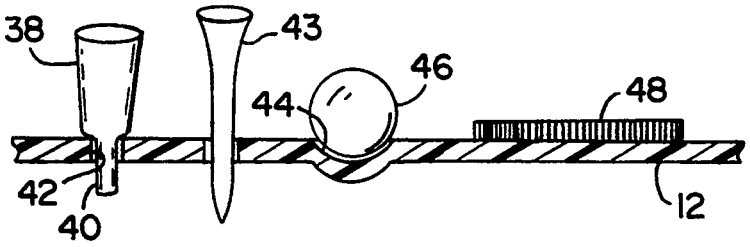
FIG. 3 is a cross-section of the playing board showing the use of various playing pieces.

Detachable markers or playing pieces 36 are distributed singly on most of the position marks 32 at the start of each game. In the preferred embodiment of FIGS. 1 and 2 playing pieces 36 are pegs having a top 38 and leg portion 40. The position marks 32 of FIG. 1, as shown in FIG. 3, have receiving pegholes 42 sized to receive peg legs 40 to support the pegs in an upright position. To further enhance the golf motif actual golf tees, 43, can be used as peg-like playing pieces or position marks can be in the form of indentations 44 in game board 12 sized to receive marbles 46 used as markers or playing pieces as is done in Chinese checkers or the marks can be simply spots on the board to indicate positioning of flat discs, wafers or coins 48.

In use, the golf game of the present invention can be played by a single player as a solitaire puzzle or by individual players or teams as competition. In general, play consists of iteratively jumping playing pieces with other playing pieces and removing the jumped pieces from the board. Jumping, and thus elimination from the game, of a playing piece can be accomplished only by another piece positioned adjacent to the one to be jumped and then only if the in-line position mark on the side opposite the piece to be jumped is unoccupied, as is done in checkers. A turn is ended by the jump of a single playing piece by another. In an alternative way of playing a playing piece may be allowed to continue jumping additional pieces as long as opposite landing spots are open.

At least one position must be unoccupied to begin the game, but more positions may be left open as an alternative. In solitary play a position mark 42 located two spaces in front of the tee area 14, is left unoccupied so that the first play or move of the game can be by the playing piece initially positioned on the tee to jump the adjacent piece. Thereafter the player selects the piece to be used in additional moves. Play continues until no more pieces can be jumped, at which point the game is over. Points, or strokes, are tallied for the number and locations of remaining playing pieces. In one embodiment, strokes are accrued for each remaining playing piece according to values 30 associated with the location of each remaining piece. A playing piece remaining in the cup of the hole 28 receives one stroke, each piece on the green 26 receives two, each piece on the fairway 16 or the tee 14 is assessed three, pieces in the rough 18, sand traps 22 and water hazards 24 result in four strokes and pieces remaining in the out-of-bounds areas 20 at the end of play are assessed five strokes.

For example, a solitaire game ending with two pieces on the board, one in the cup, and one in a sand trap would result in a total of five strokes, one for the piece in the cup and four for the piece in the sand trap. If, instead, both pieces were on the green, the score would have been four, two for each of the two pieces.

This scoring system is designed to produce scores in the range of scores actually produced by golfers playing a par four golf hole to provide interest and realism. A perfectly played hole in the game of the present invention ends with a single peg located in the cup for a net score of one, a hole-in-one, with other final playing piece locations and numbers producing larger scores, a score of two corresponding to an eagle, three corresponding to birdie, four to par, five to bogie, and so on.

Figure 4:
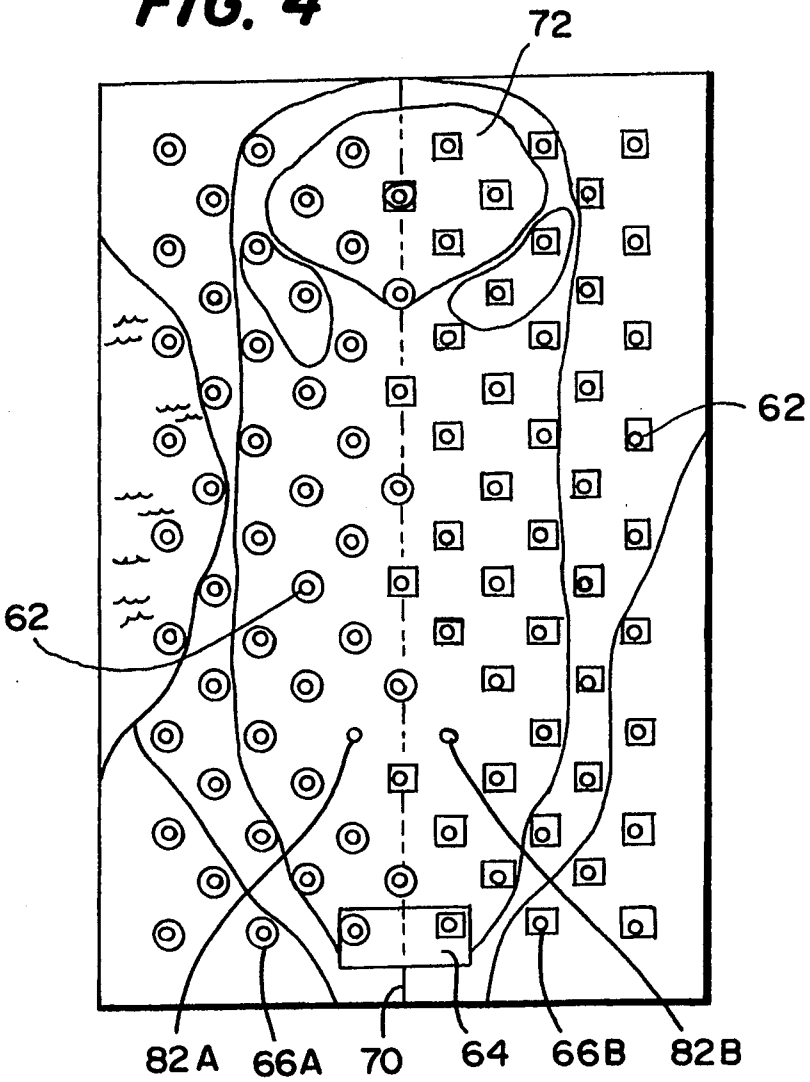
FIG. 4 is a plan view of the playing board with two types of playing pieces placed on opposite sides of the golf hole.

In another embodiment, shown in FIG. 4, the game is arranged for play by two contestants and includes a tee area 64 having at least two position marks. The playing pieces **66*a* and 66*b* consist of equal numbers of two different types, distinguishable by color, size or shape for ease of identification, and are initially distributed among the position marks 62 so that at least one position mark is left open. Each contestant is assigned a different type of playing piece. In one preferred distribution, all of the playing pieces of one contestant are positioned on one side of a line 70 drawn from the center of the tee 64, to the center of the green 72, and all of the pieces of the second contestant are positioned on the opposite side of line 70. The position marks, 82*a* and 82*b*, located two spaces in front of the tee area 64** are left unoccupied so that the first play or move of each contestant can be made by using the pieces initially positioned in the tee area.

The play of the game by two contestants can consist of alternating turns each governed by the rules of play as described for the solitaire game, consisting of eliminating playing pieces by jumping with other such pieces, with the constraint that a player may only perform a jump with one of his or her own playing pieces.

The number of times a player may jump his or her own playing pieces can be made a strategic aspect of the game by allowing, for instance, up to three free jumps of one's own playing pieces, imposing a one stroke penalty for a fourth self-jump, two penalty strokes for a fifth and so on making it increasingly costly to jump one's own pieces. Having no such constraint on the players' choices as to which pieces to jump adds an alternative variation in strategy and play of the game.

Figure 5:
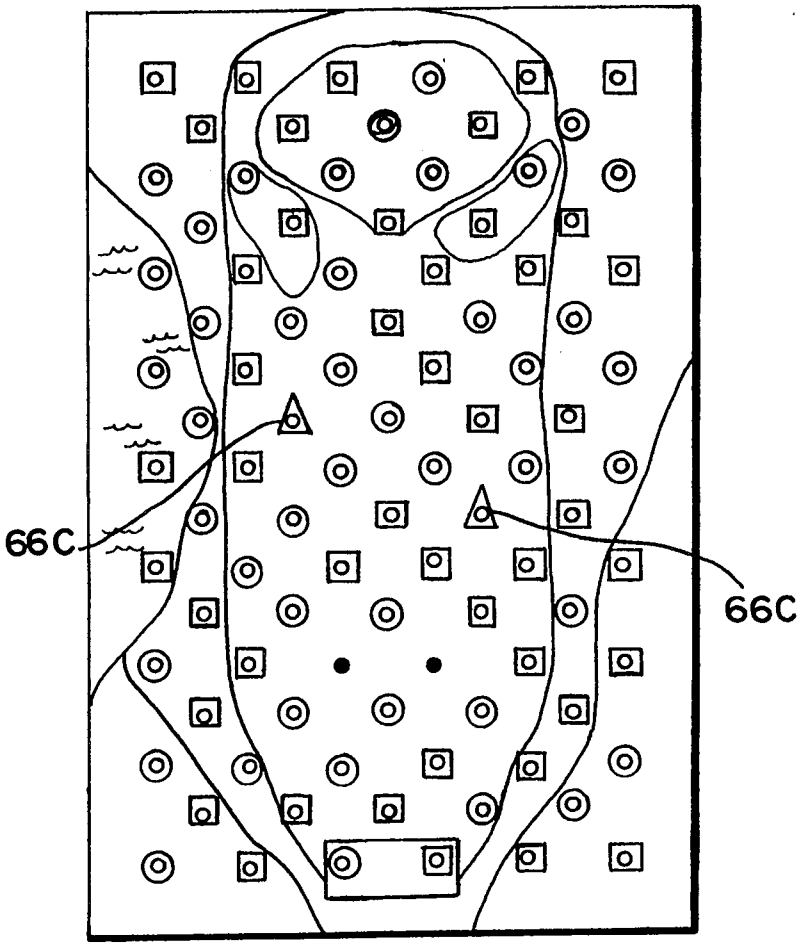
FIG. 5 is a plan view of the playing board with randomly distributed playing pieces of two types and an obstacle piece.

Another easily instituted variation providing a vast array of possibilities is to randomly place the playing pieces of the two players on the position marks instead of segregating them on the two sides of the board. Moreover a third type of playing piece, an obstacle piece, distinct from those used by the two players, shown as **66*c*** in FIG. 5, can be selectively or randomly placed in the playing board, representing trees or other such hazards, that can neither jump nor be jumped and must, instead, be played around.

Figure 6:
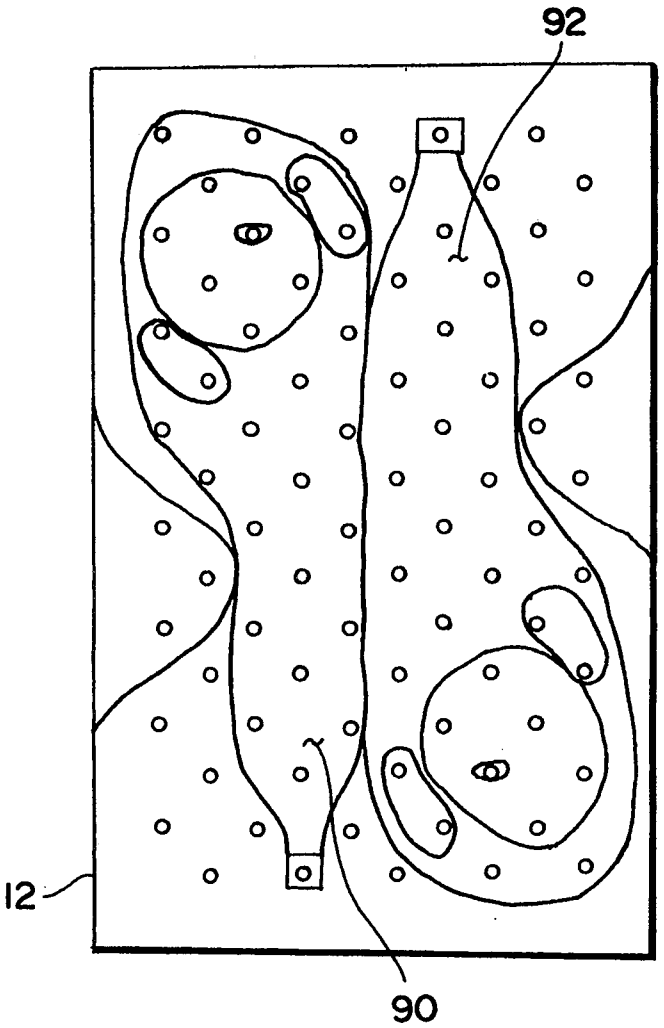
FIG. 6 is a plan view of a playing board with two oppositely directed golf holes.

In another embodiment for two players, shown in FIG. 6, the playing board can be imprinted with two golf holes 90 and 92 running parallel to each other either in the same or opposite directions. The object of each player in this variation is, as before, to minimize his or her stroke total by generally minimizing the number of playing pieces remaining when no more jumps can be made and further minimizing the distance these pieces remain from the golf hole cup at the finish.

It can be easily appreciated that the golf board game of the present invention is easily understood and quickly set-up for use as a solitary entertainment or as a competitive game for two players, providing both an appearance and a scoring procedure reminiscent of the play of an actual golf hole. The many simply effected variations in the basic game allow one or more players to enjoy repeated exercises of skill and strategy without the disadvantages of mastery or boredom.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A method of playing a golf board game comprising:

(a) superimposing an orthogonally and diagonally aligned array of means for indicating playing piece positions over a playing board having a graphical depiction of a golf hole thereupon including differentiated areas representing a tee, fairway, green, cup, rough, sand traps, water hazards and out-of-bounds;

(b) assigning stroke values to said differentiated areas;

(c) placing detachable playing pieces on all but at least one of said means for indicating playing piece positions;

(d) iteratively jumping first playing pieces over adjacently located second playing pieces onto unoccupied in-line adjacent means for indicating playing piece positions to eliminate said second pieces from said board until no further such jumps can be made; and (e) tallying a score for the play of said golf hole by summing the stroke values associated with the means for indicating playing piece positions of each remaining playing piece.

2. The method of claim 1 wherein said detachable playing pieces comprise equal numbers of two distinguishable types and said pieces are placed on all but at least two means for indicating playing piece positions.

3. The method of claim 1 further comprising placing at least one distinguishably marked detachable obstacle piece on at least one of said means for indicating playing piece position, said at least one obstacle piece being allowed to neither jump nor be jumped by said playing pieces in the play of the game.

* * * * *